US008622758B2

(12) United States Patent
Hsu et al.

(10) Patent No.: US 8,622,758 B2
(45) Date of Patent: Jan. 7, 2014

(54) ROTATABLE PLUG AND POWER SUPPLY DEVICE HAVING THE ROTATABLE PLUG

(75) Inventors: Chia-Tsang Hsu, Taipei (TW); Chien-Hua Chu, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 0 days.

(21) Appl. No.: 13/556,362

(22) Filed: Jul. 24, 2012

(65) Prior Publication Data

US 2013/0237073 A1 Sep. 12, 2013

(30) Foreign Application Priority Data

Mar. 7, 2012 (CN) ..... 2012 2 0083223 U

(51) Int. Cl.
*H01R 13/44* (2006.01)

(52) U.S. Cl.
USPC ..... 439/131

(58) Field of Classification Search
USPC ..... 439/131
See application file for complete search history.

(56) References Cited

U.S. PATENT DOCUMENTS

| | | | | |
|---|---|---|---|---|
| 5,494,449 | A * | 2/1996 | Chioo | 439/76.1 |
| 5,628,641 | A * | 5/1997 | Hahn | 439/131 |
| 6,275,002 | B1 * | 8/2001 | Chen | 320/111 |
| 7,001,196 | B1 * | 2/2006 | Huang | 439/320 |

* cited by examiner

*Primary Examiner* — James Harvey
(74) *Attorney, Agent, or Firm* — Rosenberg, Klein & Lee

(57) ABSTRACT

A rotatable plug includes a casing unit having a first casing part and a second casing part with a pair of receiving spaces, a pair of conductive terminals respectively having conductive sections, and a rotatable unit including a pivot shaft, a pair of conductive prongs connected transversely to the pivot shaft, and a pair of conductive protrusions protruding out from the pivot shaft. The rotatable unit is rotatable relative to the casing unit between non-use and use positions, where the conductive prongs are accommodated in and extend out of the receiving spaces, respectively. Each conductive protrusion has at least two points of contact with the conductive section of a respective conductive terminal.

15 Claims, 14 Drawing Sheets

ROTATABLE PLUG AND POWER SUPPLY DEVICE HAVING THE ROTATABLE PLUG

CROSS-REFERENCE TO RELATED APPLICATION

This application claims priority to Chinese Patent Application No. 201220083223.5, filed on Mar. 7, 2012.

BACKGROUND OF THE INVENTION

1. Field of the Invention

The invention relates to a rotatable plug, more particularly to a rotatable plug that can be stored conveniently when not in use and a power supply device having the rotatable plug.

2. Description of the Related Art

A plug of a conventional power supply device includes a plug body and two conductive terminals protruding outwardly from the plug body. When the power supply device is not in use, because the conductive terminals protrude from the plug body, they are likely to be hit by an external force that may result in the bending and even breakage thereof. Further, it is difficult to store the conventional power supply device. Therefore, devices with rotatable plugs have been currently developed to resolve the aforesaid issues.

Referring to FIGS. 1, 2 and 3, a conventional power supply device having a rotatable plug includes a housing 11, a rotatable plug 12 and a fixing element 13. The housing 11 includes a housing body 111, a holding seat 112 formed on an end of the housing body 111, and a receiving hole 113 extending through the holding seat 112.

The rotatable plug 12 includes a rotating support body 121 inserted into the receiving hole 113, two conductive prongs 122 fixed on the rotating support body 121, two metal pivot studs 123 protruding outwardly and respectively from two opposite ends of the rotating support body 121, two conductive plates 124 respectively pivoted to the pivot studs 123, and three projections 125, 126 projecting from the rotating support body 121 opposite to the conductive prongs 122. Two conductive wires (not shown) may be respectively inserted through the conductive plates 124 to connect electrically with a circuit board (not shown).

The fixing element 13 fixes the rotatable plug 12 to the holding seat 112, and includes a fixing main body 131, two stop bosses 132 disposed on one side of the fixing main body 131 and extending towards the housing body 111, a stepped portion formed in the middle of the fixing main body 131 and having a first part 133 and a second part 134, and two spaced-apart slots 135 formed in the fixing main body 131. The conductive plates 124 extend respectively through the slots 135.

The housing 11 (see FIG. 1) is removed in FIGS. 2 and 3 to facilitate description of the rotating mechanism of the rotatable plug 12. With reference to FIG. 2, when the conductive prongs 122 of the rotatable plug 12 are in a use or extended position, the projection 125 abuts against the first and second parts 133, 134 of the stepped portion and is positioned thereat. When a force is applied on the conductive prongs 122 to rotate the same in a direction of an arrow (R1), through the resiliency of the stepped portion, the projection 125 can slide over the second part 134. As such, the conductive prongs 122 can drive the rotating support body 121 to rotate relative to the holding seat (see FIG. 1). As shown in FIG. 3, the projection 126 is blocked by the stop boss 132 and is positioned thereat. At this state, the conductive prongs 122 are disposed in a non-use or folded position. By applying a force again on the conductive prongs 122 to rotate the same in a direction of an arrow (R2), the conductive prongs 122 are restored to their use position.

However, the above-mentioned device is not modular so that a new mold must be opened in respond to different sizes of housing 11. Moreover, three projections 125, 126 are needed to position the rotatable plug 12 in the use and non-use positions. Finally, because the rotatable plug 12 is connected to the fixing element 13 through insertion of the conductive plates 124 into the slots 135, the conductive plates 124 are likely to separate from the fixing element 13 due to frequent use which may cause poor electrical contact.

SUMMARY OF THE INVENTION

Therefore, an object of the present invention is to provide a rotatable plug that can provide a stable and reliable electrical connection.

Another object of the present invention is to provide a power supply device having a rotatable plug that can provide a stable and reliable electrical connection.

According to one aspect of this invention, a rotatable plug comprises a casing unit, a pair of conductive terminals and a rotatable unit.

The casing unit includes a first casing part, and a second casing part connected to the first casing part and formed with a pair of receiving spaces. The conductive terminals are insert molded into the first casing part. Each of the conductive terminals has a conductive section. The rotatable unit includes a pivot shaft, a pair of conductive prongs connected to and extending transversely from the pivot shaft, and a pair of conductive protrusions protruding out from the pivot shaft. The rotatable unit is disposed in the casing unit and is rotatable relative to the casing unit between a non-use and folded position, where the conductive prongs are respectively accommodated in the receiving spaces, and a use or extended position, where the conductive prongs respectively extend out of the receiving spaces. Each of the conductive protrusions is disposed on and has at least two points of contact with the conductive section of a respective one of the conductive terminals when the rotatable unit is in the use position.

Preferably, the conductive section of each of the conductive terminals has a depressed contact surface.

Each of the conductive protrusions has the at least two points of contact with the depressed contact surface.

Preferably, the first casing part includes a pair of first support posts each having a slotted surface. Each of the conductive terminals further has a conductive end protruding from the slotted surface. The pivot shaft includes two outer conductive shaft sections respectively connected to the prongs, and an insulated middle shaft section between the outer conductive shaft sections. The outer conductive shaft sections are respectively in contact with the conductive ends of the conductive terminals when the rotatable unit is in the use and non-use positions.

Preferably, the first casing part includes a pair of second support posts supporting the pivot shaft.

Preferably, the first casing part has a positioning portion formed with a positioning groove. The rotatable unit further includes a first protuberance and a second protuberance protruding from the pivot shaft between the conductive protrusions and perpendicular to each other. The first protuberance is positioned in the positioning groove when in the non-use position, and the second protuberance is positioned in the positioning groove when in the use position.

Preferably, each of the conductive terminals further has a conductive extension disposed externally of the casing unit.

Preferably, the conductive extensions of the conductive terminals have different lengths.

According to another aspect of this invention, a power supply device comprises a housing unit, a circuit unit and a rotatable plug.

The housing unit includes a first housing element having two parallel slots, and a second housing element connected to and cooperating with the first housing element to define a chamber. The circuit unit is disposed in the chamber. The rotatable plug is disposed in the chamber and includes a casing unit, a pair of conductive terminals and a rotatable unit.

The casing unit includes a first casing part, and a second casing part connected to the first casing part and formed with a pair of receiving spaces. The conductive terminals are insert molded into the first casing part and are connected electrically to the circuit unit. Each of the conductive terminals has a conductive section. The rotatable unit includes a pivot shaft, a pair of conductive prongs connected transversely to the pivot shaft, and a pair of conductive protrusions protruding out from the pivot shaft. The rotatable unit is disposed in the casing unit and is rotatable relative to the casing unit between a non-use or folded position, where the conductive prongs are respectively accommodated in the receiving spaces and the slots, and a use or extended position, where the conductive prongs respectively extend out of the receiving spaces and the slots. Each of the conductive protrusions is disposed on and has at least two points of contact with the conductive section of a respective one of the conductive terminals when the rotatable unit is in the use position.

Preferably, each of the receiving spaces includes a cover-receiving section, and a prong-receiving section communicating spatially with said cover-receiving section. Each of the slots has a length greater than or equal to a length of a corresponding receiving space and a width greater than or equal to a width of a corresponding prong-receiving section.

The effect of this invention resides in that because each arcuate conductive protrusion has at least two points of contact with the depressed contact surface of the corresponding conductive section, the rotatable plug of the present invention has a good effect of conduction. Further, the conductive terminals are insert molded into the first casing part so that only the conductive sections and the conductive ends thereof protrude inwardly from the inner surface of the first casing part, the fixing method thereof is stable and the electrical connection process thereof is reliable. Finally, with only the first and second protuberances cooperating alternately with the positioning groove to position the rotatable unit in the non-use and use positions, and with the connection of the first and second casing parts, the present invention can be modular.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

The above-mentioned and other technical contents, features, and effects of this invention will be clearly presented from the following detailed description of a preferred embodiment in coordination with the reference drawings.

Referring to FIGS. 4 to 20, a power supply device according to the preferred embodiment of the present invention comprises a housing unit 5, a circuit unit, and a rotatable plug 200.

Figure 18:
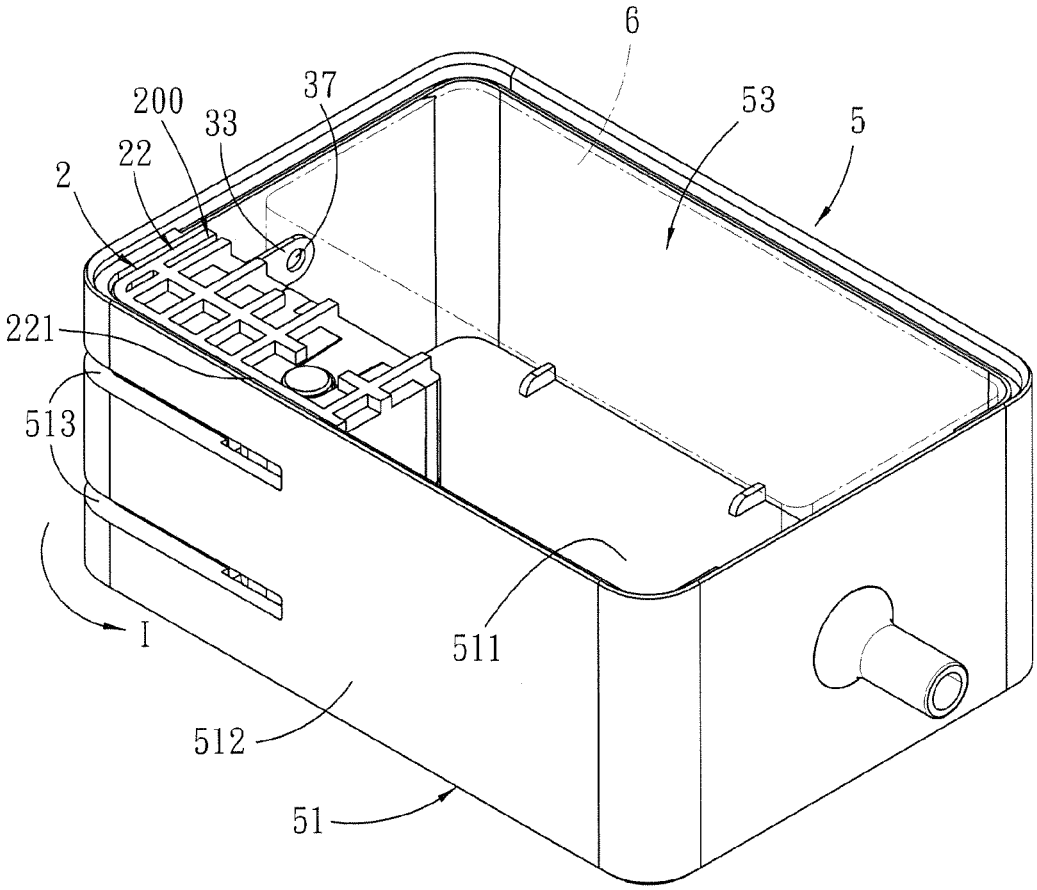
FIG. 18 is a perspective view of the power supply device with a second housing element thereof being removed to illustrate how the rotatable plug is disposed in a first housing element thereof.

The housing unit 5 includes a first housing element 51 and a second housing element 52 connected to and cooperating with the first housing element 51 to define a chamber 53 (see FIG. 18). The first housing element 51 has a base wall 511, a surrounding wall 512 extending transversely from the base wall 511, and two parallel slots 513 formed in the surrounding wall 512.

Figure 19:
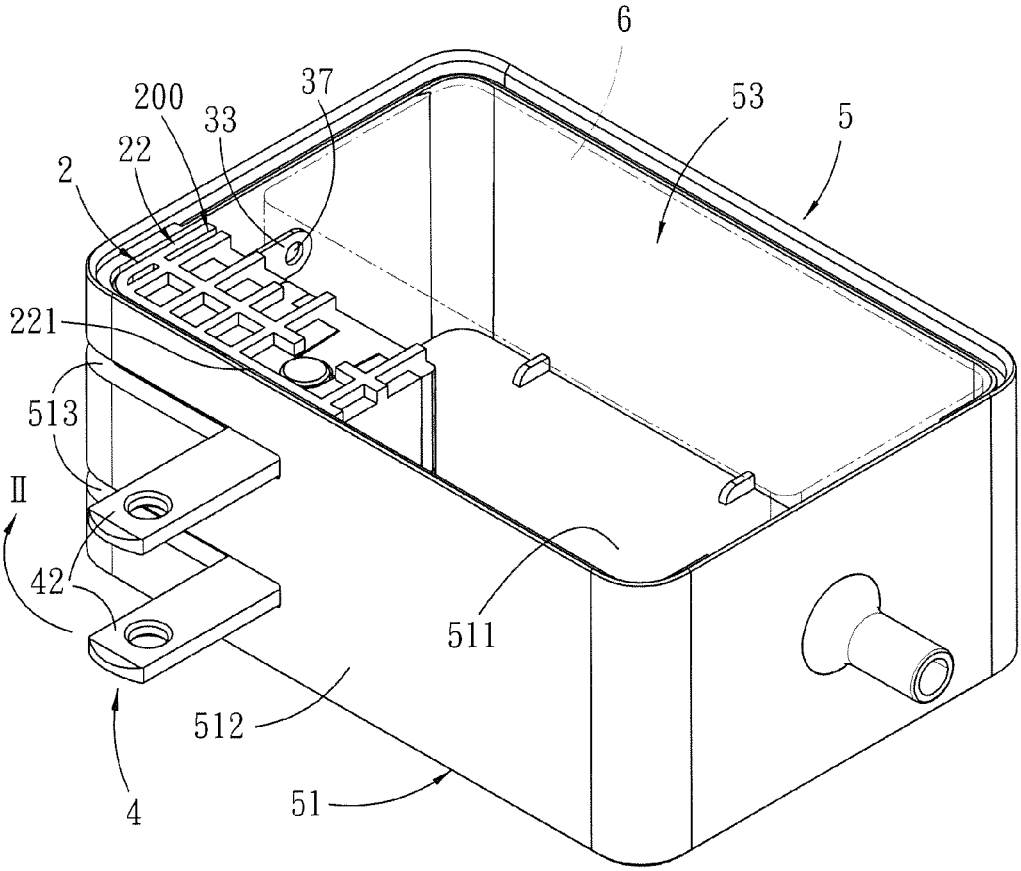
FIG. 19 is a view similar to FIG. 18, but with the conductive prongs of the rotatable plug being rotated from the non-use position to the use position.

As shown in FIGS. 18 and 19, the circuit unit 6 and the rotatable plug 200 are disposed in the chamber 53.

Figure 1:
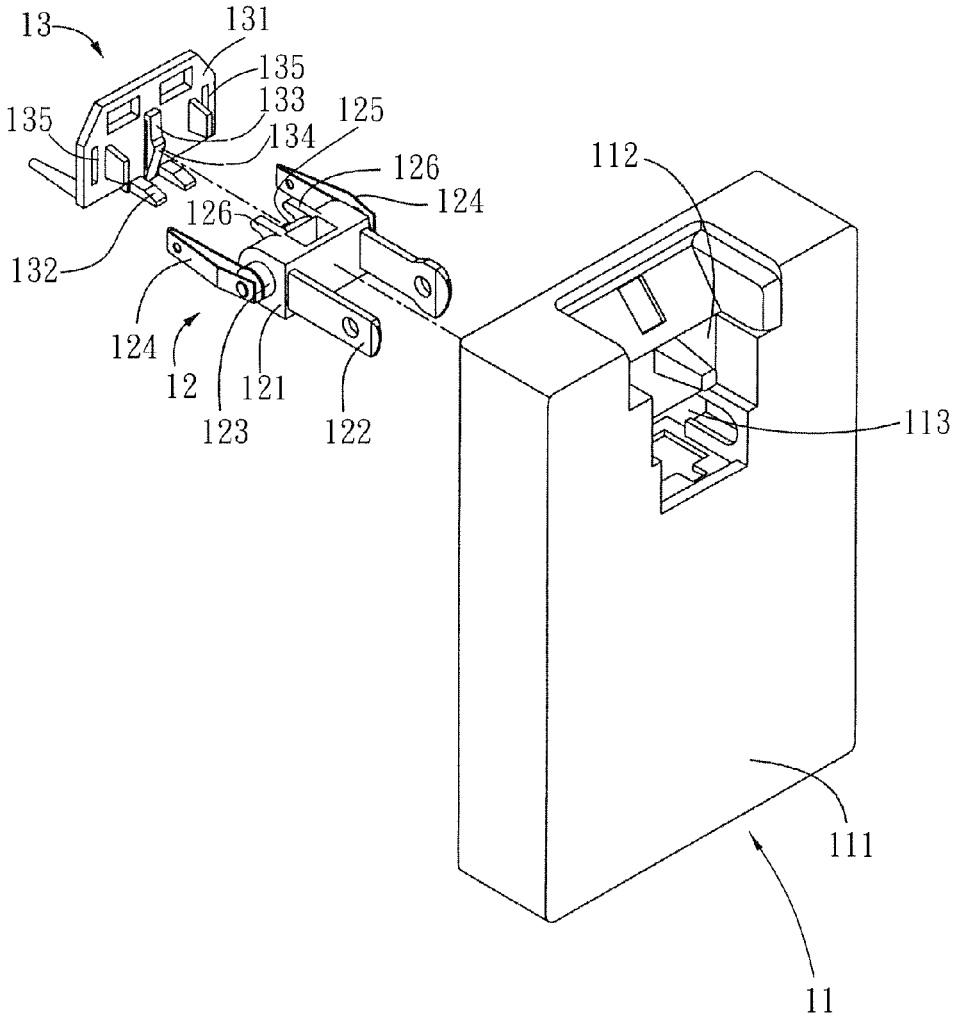
FIG. 1 PRIOR ART
FIG. 1 is an exploded perspective view of a conventional power supply device having a rotatable plug.
Figure 2:
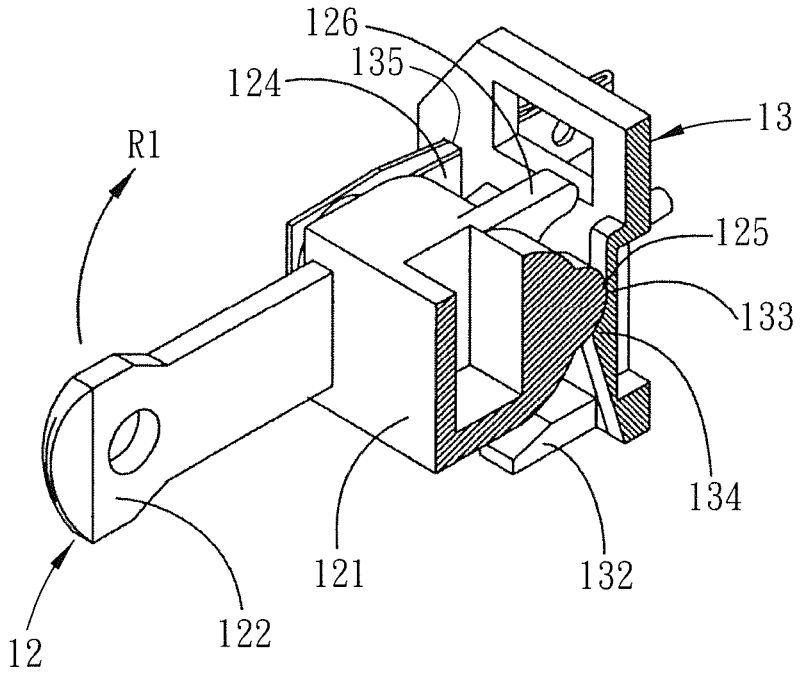
FIG. 2 PRIOR ART
FIG. 2 is a fragmentary perspective view of the conventional power supply device, illustrating a conductive prong in a use position.
Figure 3:
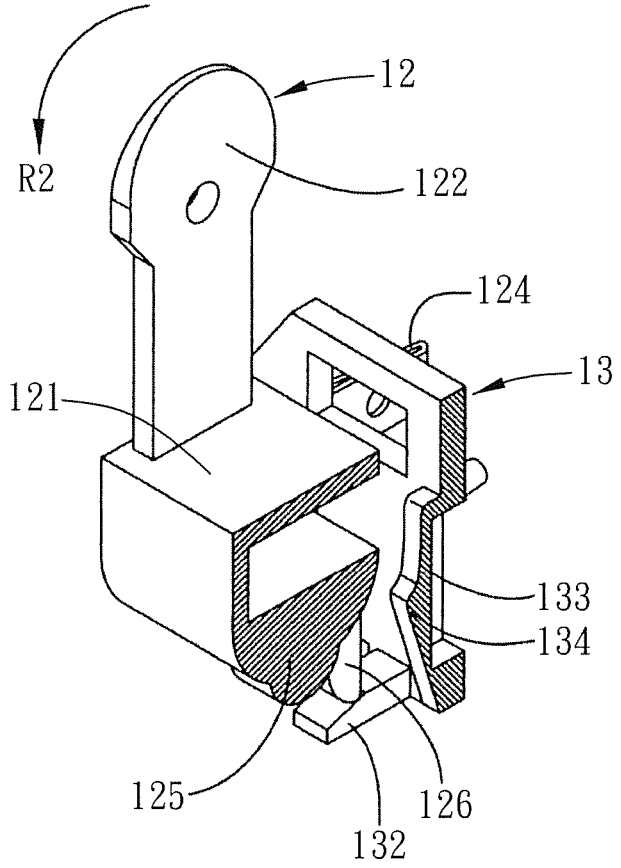
FIG. 3 PRIOR ART
FIG. 3 is a view similar to FIG. 2, but illustrating the conductive prong in a non-use position.
Figure 4:
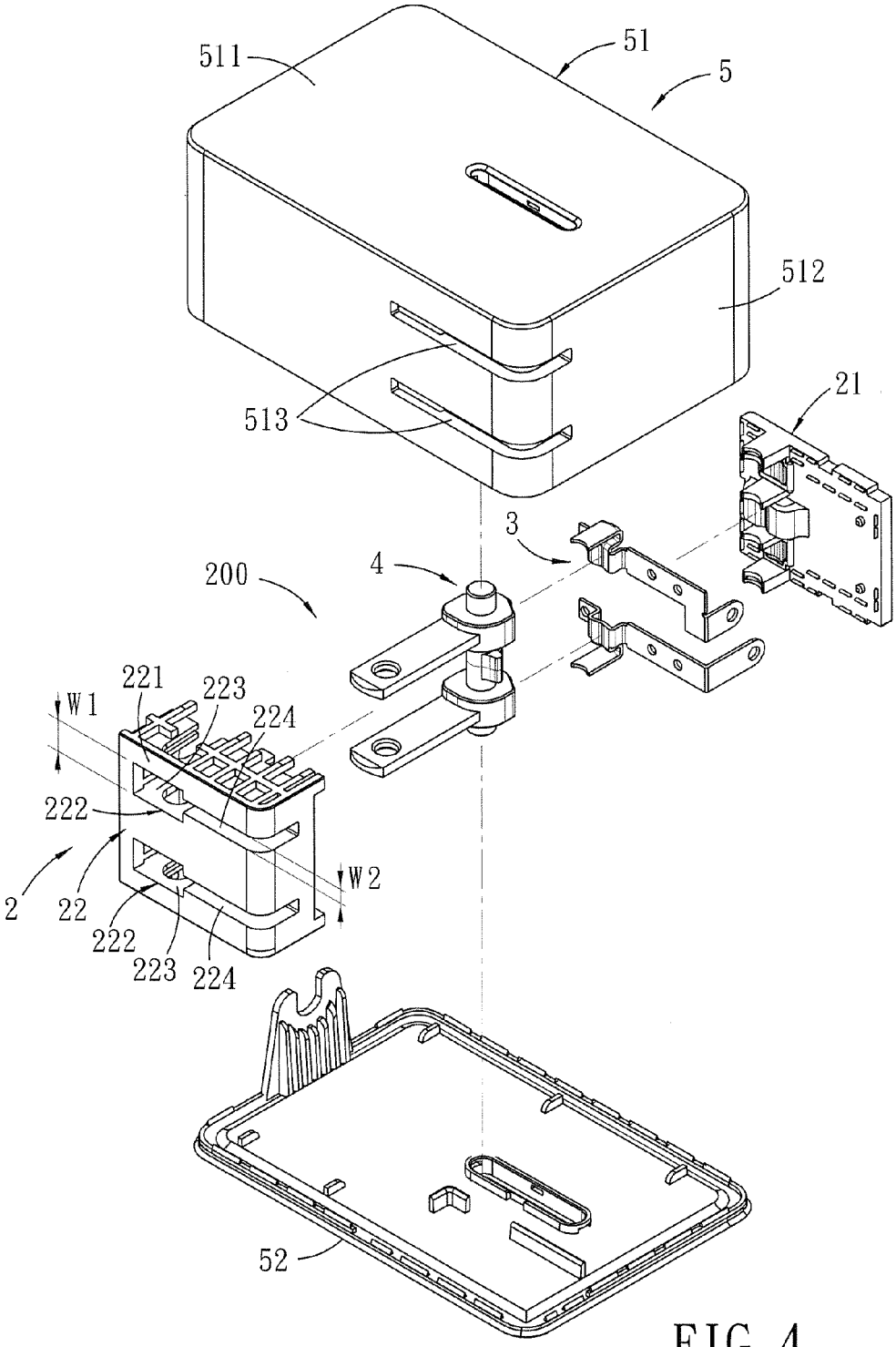
FIG. 4 is an exploded perspective view of a power supply device having a rotatable plug according to the preferred embodiment of the present invention.
Figure 5:
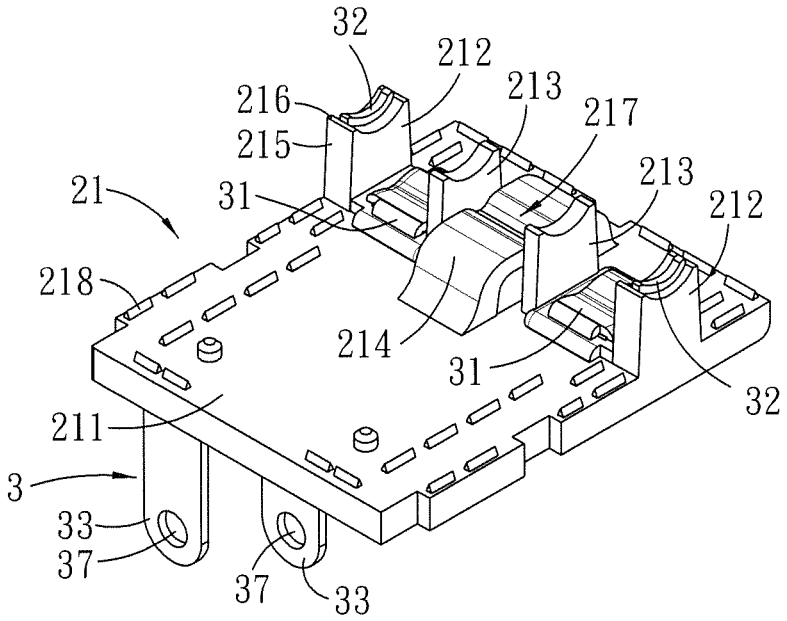
FIG. 5 is a perspective view of a first casing part of the rotatable plug.

With reference to FIGS. 4 and 5, the rotatable plug 200 includes a casing unit 2, a pair of conductive terminals 3 and a rotatable unit 4. The casing unit 2 includes a first casing part 21 and a second casing part 22 connected to the first casing part 21. The first casing part 21 includes a plate-shaped body 211, a pair of first support posts 212 extending inwardly and respectively from two opposite sides of the plate-shaped body 211, a pair of second support posts 213 disposed between the first support posts 212, and a positioning portion 214 extending inwardly from the plate-shaped body 211 and disposed between the second support posts 213. Specifically, each first support post 212 is hollow, extends from an inner surface of the plate-shaped body 211 at the two opposite sides thereof, and has an arcuate slotted surface 216 distal from the plate-shaped body 211. The positioning portion 214 is formed with a central positioning groove 217.

The conductive terminals 3 are insert molded into the first casing part 21 and are connected electrically to the circuit unit 6. Each of the conductive terminals 3 has a conductive section 31 disposed between one of the first support posts 212 and a corresponding second support post 213, a conductive end 32 protruding from the slotted surface 216 of a respective first support post 212, and a conductive extension 33 opposite to the conductive end 32 and extending from an outer surface of the plate-shaped body 211. The conductive section 31 has a depressed contact surface 311. The conductive end 32 is arcuate.

Figure 6:
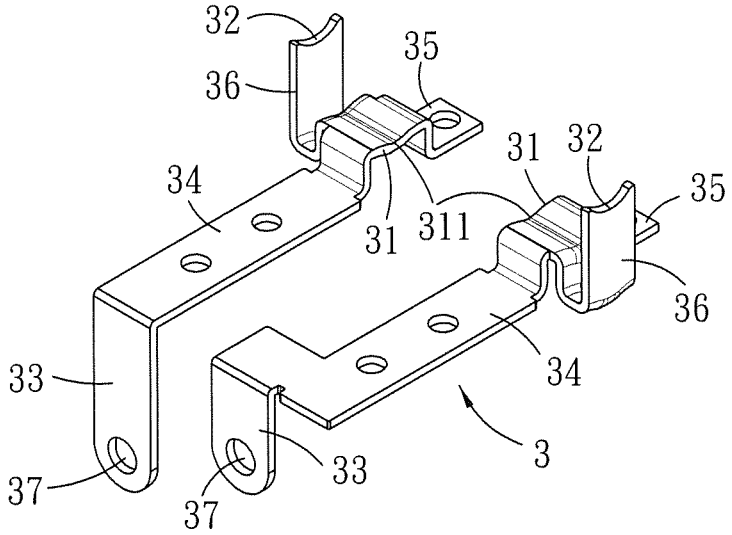
FIG. 6 is a perspective view of a pair of conductive terminals of the rotatable plug.

The configuration of each conductive terminal 3 before being insert molded into the first casing part 21 is as shown in FIG. 6. The conductive section 31 of each conductive terminal 3 is substantially U-shaped, and includes a bight portion having the depressed contact surface 311, and two arms extending transversely from two opposite ends of the bight portion. Each conductive terminal 3 further has a first conductive plate 34 and a second conductive plate 35 respectively connected to and extending horizontally from the two opposite arms of the conductive section 31, and a third conductive plate 36 that is substantially J-shaped and that has one end connected to the bight portion and another end having the arcuate conductive end 32. The conductive extension 33 extends from one end of the first conductive plate 34 that is distal from the conductive section 31. To easily distinguish the positive and negative polarities of the conductive terminals 3, the two conductive extensions 33 have different lengths. The conductive extension 33 has a through hole 37. Two conductive wires (not shown) can be soldered to the through holes 37 in the conductive extensions 33 of the conductive terminals 3 to connect electrically with the conductive extensions 33.

Figure 7:
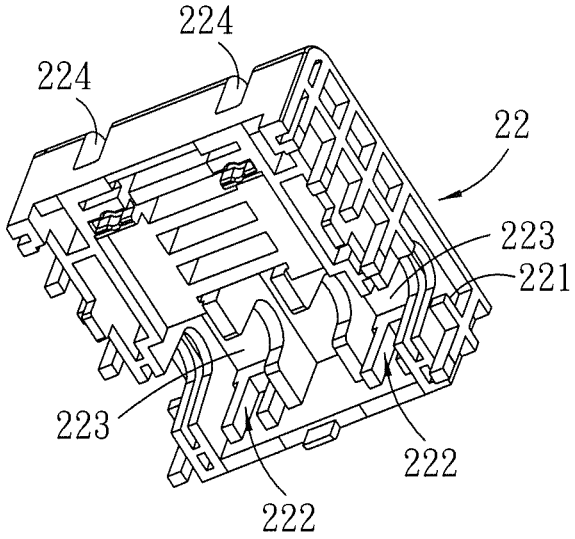
FIG. 7 is a perspective view of a second casing part of the rotatable plug.

With reference to FIGS. 4 and 7, the second casing part 22 includes a casing body 221, and a pair of parallel receiving spaces 222 formed in the casing body 221. Each of the receiving spaces 222 includes a cover-receiving section 223, and a prong-receiving section 224 communicating spatially with the cover-receiving section 223.

Figure 8:
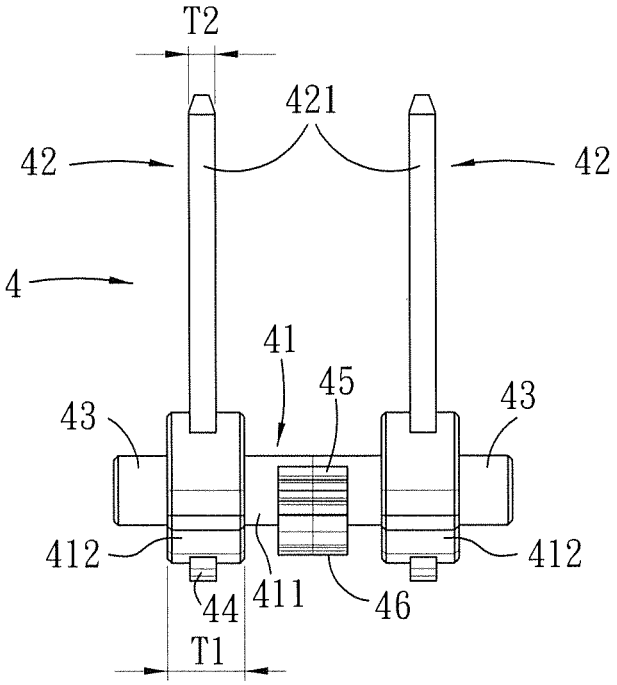
FIG. 8 is a perspective view of a rotatable unit of the rotatable plug.
Figure 9:
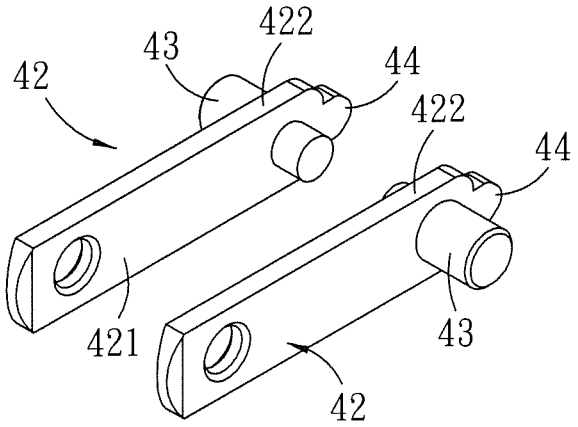
FIG. 9 is a perspective view of a pair of conductive prongs of the rotatable plug.

With reference to FIGS. 8 and 9, the rotatable unit 4 includes a pivot shaft 41, and a pair of parallel conductive prongs 42 connected transversely to the pivot shaft 41. The pivot shaft 41 includes two outer conductive shaft sections 43 respectively connected to the prongs 42, an insulated middle shaft section 411 between the outer conductive shaft sections 43, and two cover sections 412 disposed respectively on two opposite ends of the middle shaft section 411. Each of the cover sections 412 covers a junction of the outer conductive shaft sections 43 and a respective prong 42. A first protuberance 45 and a second protuberance 46 protrude outwardly from the middle shaft section 411, are perpendicular to each other, and are made of insulated materials. A pair of conductive protrusions 44 respectively protrudes out from the cover sections 412 of the pivot shaft 41.

In actual applications, the rotatable unit 4 has the prongs 42, which are made of metal, insert molded to the pivot shaft 41 such that the cover sections 412 of the pivot shaft 41 cover partially the prongs 42. Before the prongs 42 are insert molded to the pivot shaft 41, the configuration thereof is as shown in FIG. 9. Each of the prongs 42 includes an elongated insert section 421, and a connecting section 422 opposite to the insert section 421. The conductive protrusions 44 protrude outwardly and respectively from the connecting sections 422 of the prongs 42, and are disposed externally of the cover sections 412, respectively.

With reference to FIGS. 4, 5, 8 and 10, to assemble the rotatable plug of the present invention, the rotatable unit 4 is first connected to the second casing part 22 by inserting the cover sections 412 of the pivot shaft 41 into the corresponding cover-receiving sections 223 of the receiving spaces 222 and the prongs 42 into the corresponding prong-receiving sections 224 of the receiving spaces 222. At this time, a portion of the insert section 421 of each prong 42 extends out of the corresponding prong-receiving section 224, and the outer conductive shaft sections 43 are exposed from lateral sides of the casing body 221 (only one is visible in FIG. 10). The second casing part 22 and the rotatable unit 4 are then integrated with the first casing part 21 such that the middle shaft section 411 of the pivot shaft 41 abuts against the second support posts 213 and the outer conductive shaft sections 43 abut against and electrically coupled to the conductive ends 32 of the conductive terminals 3. Finally, because the first casing part 21 further includes a plurality of welding spots 218 arranged on a periphery of the inner surface of the plate-shaped body 211, the first and second casing parts 21, 22 are integrated together using an ultrasonic welding process.

With reference to FIGS. 10 to 13, the rotatable unit 4 is disposed in the casing unit 2 and is rotatable relative to the same between a non-use or folded position and a use or extended position. The second casing part 22 is removed in FIGS. 11 and 13 to facilitate description of the positioning mechanism of the rotatable unit 4 during the non-use and use positions.

Figure 10:
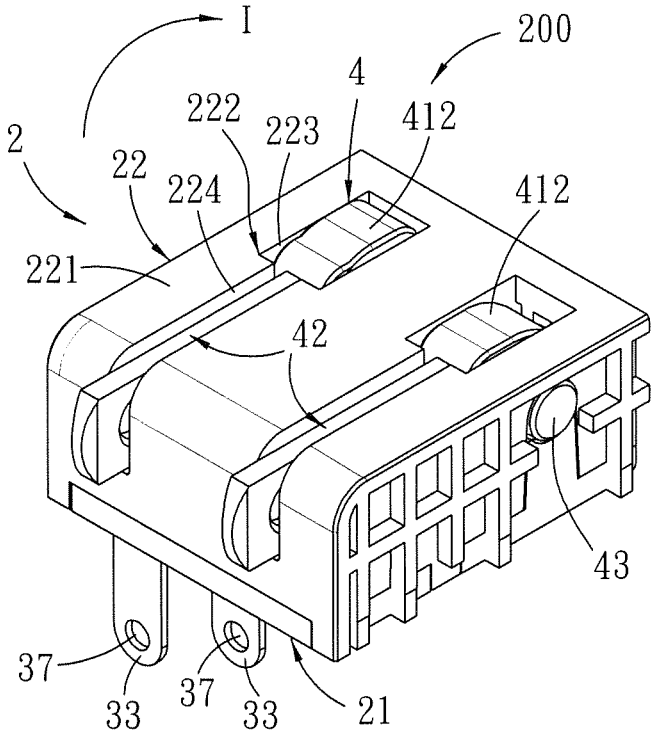
FIG. 10 is an assembled perspective view of the rotatable plug in a non-use position.
Figure 11:
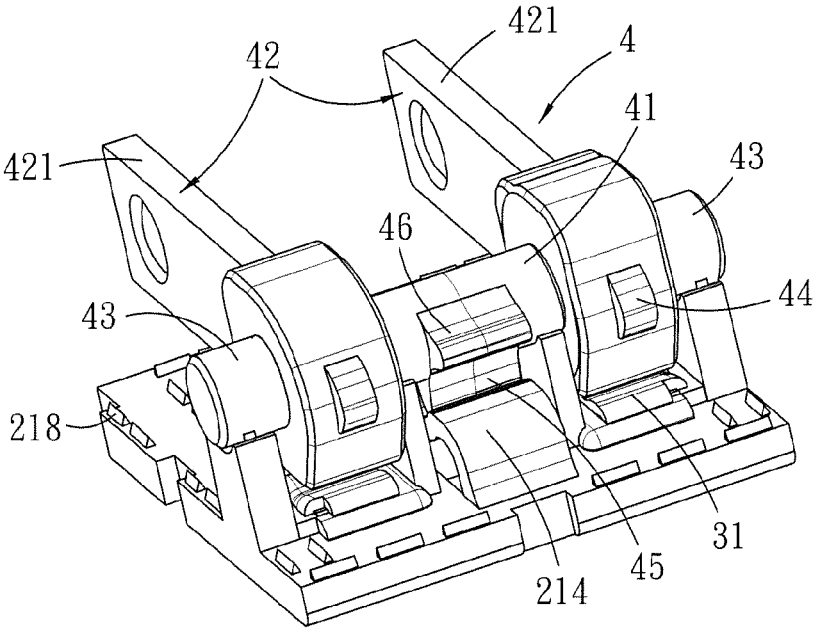
FIG. 11 is a perspective view of the rotatable plug in the non-use position with the second casing part thereof removed for clarity's sake.
Figure 12:
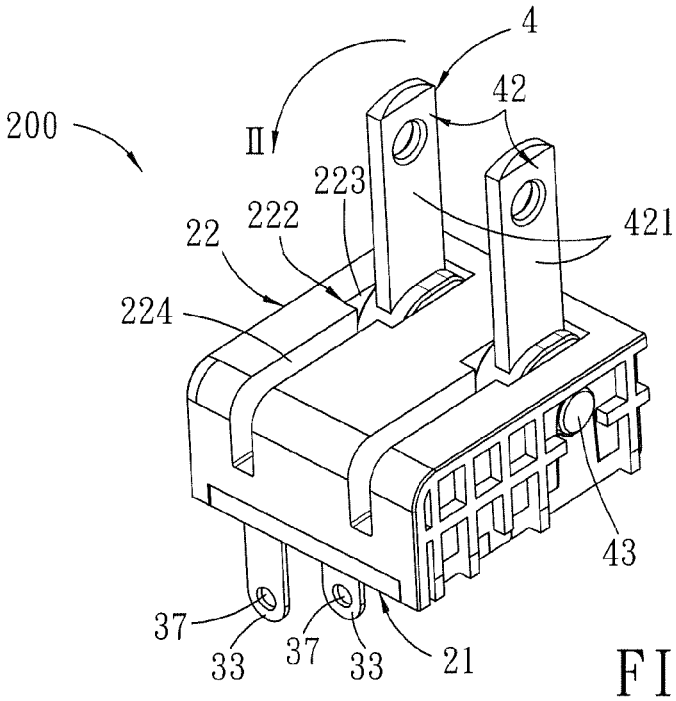
FIG. 12 is a view similar to FIG. 10, but with the rotatable plug in a use position.
Figure 13:
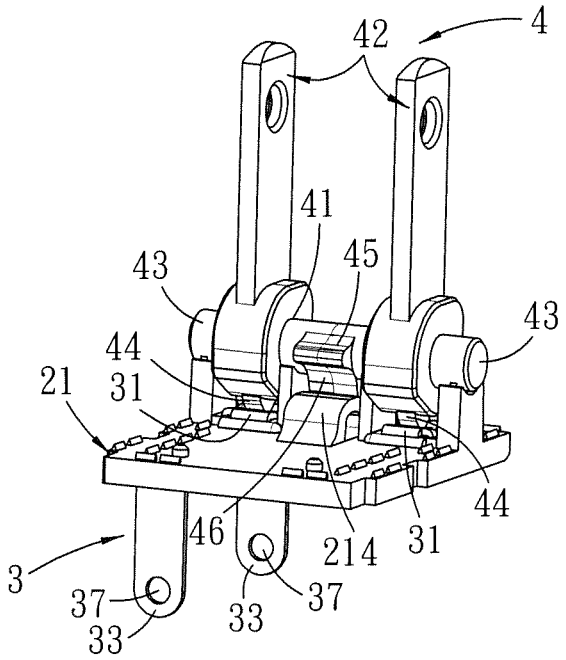
FIG. 13 is a perspective view of the rotatable plug in the use position with the second casing part thereof removed for clarity's sake.
Figure 14:
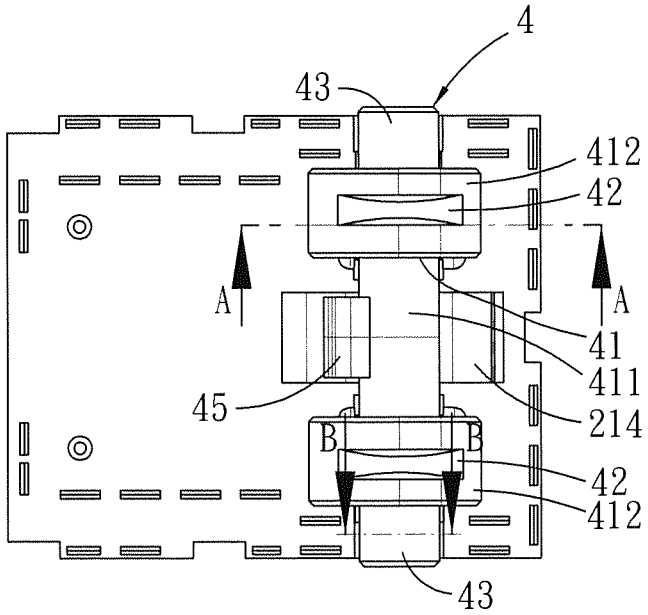
FIG. 14 is a schematic top view of the rotatable plug in the use position with the second casing part thereof removed.
Figure 15:
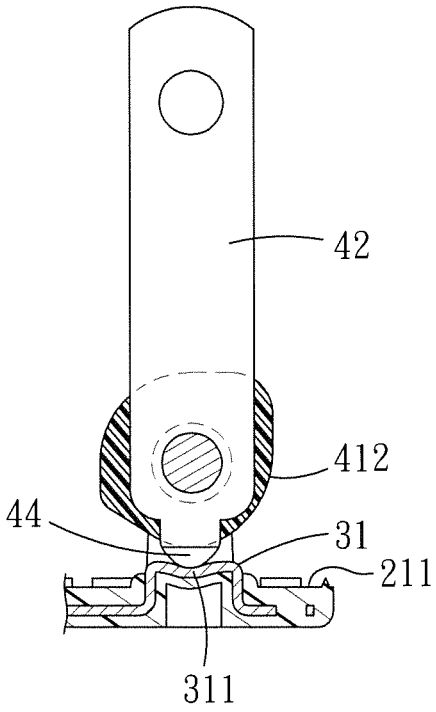
FIG. 15 is a sectional view of the rotatable plug taken along line A-A of FIG. 14.
Figure 16:
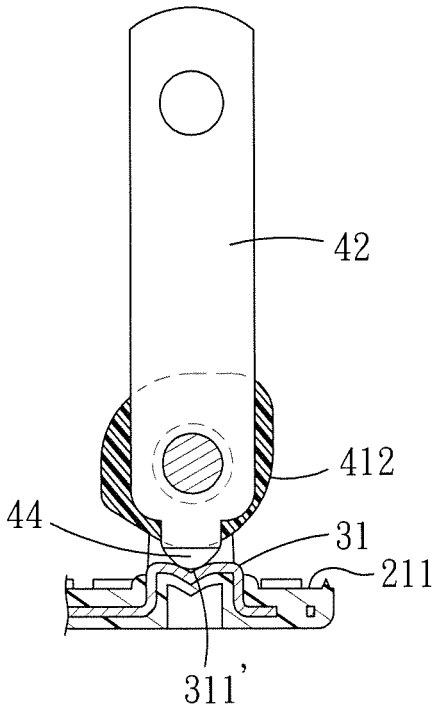
FIG. 16 is a view similar to FIG. 15, but showing a conductive protrusion in two points of contact with a V-shaped conductive section.

Referring to FIGS. 10 and 11, when the rotatable unit 4 is in the non-use position, the insert sections 421 of the prongs 42 are respectively accommodated in the prong-receiving sections 224 with the portions thereof protruding from the corresponding prong-receiving sections 224, and the first protuberance 45 is positioned in the positioning groove 217 (see FIG. 5). When the insert sections 421 of the prongs 42 are rotated in the direction of an arrow (I) to extend out of the prong-receiving sections 224, the second protuberance 46 is positioned in the positioning groove 217, as shown in FIGS. 12 to 14. As shown in FIG. 15, the conductive protrusion 44 is disposed on the conductive section 31. Since the conductive section 31 has the depressed contact surface 311 and the conductive protrusion 44 is arcuate, the conductive protrusion 44 has at least two points of contact with the conductive section 31 so that it has a large area of contact with the same to thereby enhance the effect of conduction. The conductive section 31 is not limited to having the depressed contact surface 311. As shown in FIG. 16, the conductive section 31 may have a substantially V-shaped contact surface 311', so that the conductive protrusion 44 has two points of contact with the conductive section 31. As shown in FIG. 12, when the insert sections 421 of the prongs 42 are rotated in the direction of an arrow (II), the rotatable unit 4 is rotated back to the non-use position shown in FIGS. 10 and 11.

Figure 17:
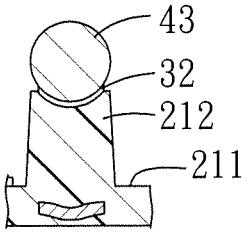
FIG. 17 is a sectional view of the rotatable plug taken along line B-B of FIG. 14.

As shown in FIG. 17, the outer conductive shaft section 43 is in constant contact with the conductive end 32 whether the rotatable unit 4 is in the non-use or use position. Hence, in the use position, as shown in FIG. 13, the conductive terminals 3 and the rotatable unit 4 are electrically coupled to each other through the aforesaid two methods, so that reliability of electrical connection can be enhanced. Further, referring once again to FIGS. 4, 8 and 10, the cover-receiving section 223 of each receiving space 222 has a width (W1), the prong-receiving section 224 of each receiving space 222 has a width (W2), each cover section 412 of the pivot shaft 41 has a thickness (T1), and each prong 42 has a thickness (T2). In the non-use position, because the width (W2) of the prong-receiving section 224 is smaller than the width (W1) of the cover-receiving section 223, and the thickness (T2) of each prong 42 is smaller than the thickness (T2) of each cover section 412, the insert sections 421 of the prongs 42 can be stably received in the prong-receiving sections 224 of the second casing part 22.

Referring back to FIGS. 11, 12 and 13, more particularly, because the conductive sections 31 have elasticity, when the conductive sections 31 are in contact with or separated from the conductive protrusions 44, the wearing thereof caused by repeated rotation between the non-use and use positions can be reduced. Further, by using the ultrasonic welding method to integrate the first and second casing parts 21, 22, the separation of the first and second casing parts 21, 22 due to the frequent switching between the non-use and use positions can be prevented.

With reference to FIGS. 18 and 19, in combination with FIG. 4, each of the slots 513 in the housing unit 5 has a length slightly longer than or equal to that of the corresponding receiving space 222, and a width larger than or equal to that of the corresponding prong-receiving section 224. The outer surface of the casing body 221 of the second casing part 22 abuts against inner surfaces of the base wall 511 and the surrounding wall 512 and is proximate to the two slots 513, so that the cover-receiving sections 223 and the prong-receiving sections 224 of the receiving spaces 222 are in spatial communication with the slots 513 to facilitate rotation of the insert sections 421 of the prongs 42 in and out of the housing unit 5.

Referring again to FIGS. 18, 19 and 20, the rotatable unit 4 is similarly rotatable relative to the casing unit 2 between the non-use or folded position and the use or extended position as described above. The difference resides in that the insert sections 421 of the prongs 42 of the rotatable unit 4 can be rotatably received in the respective slots 513 of the first housing element 51.

Figure 20:
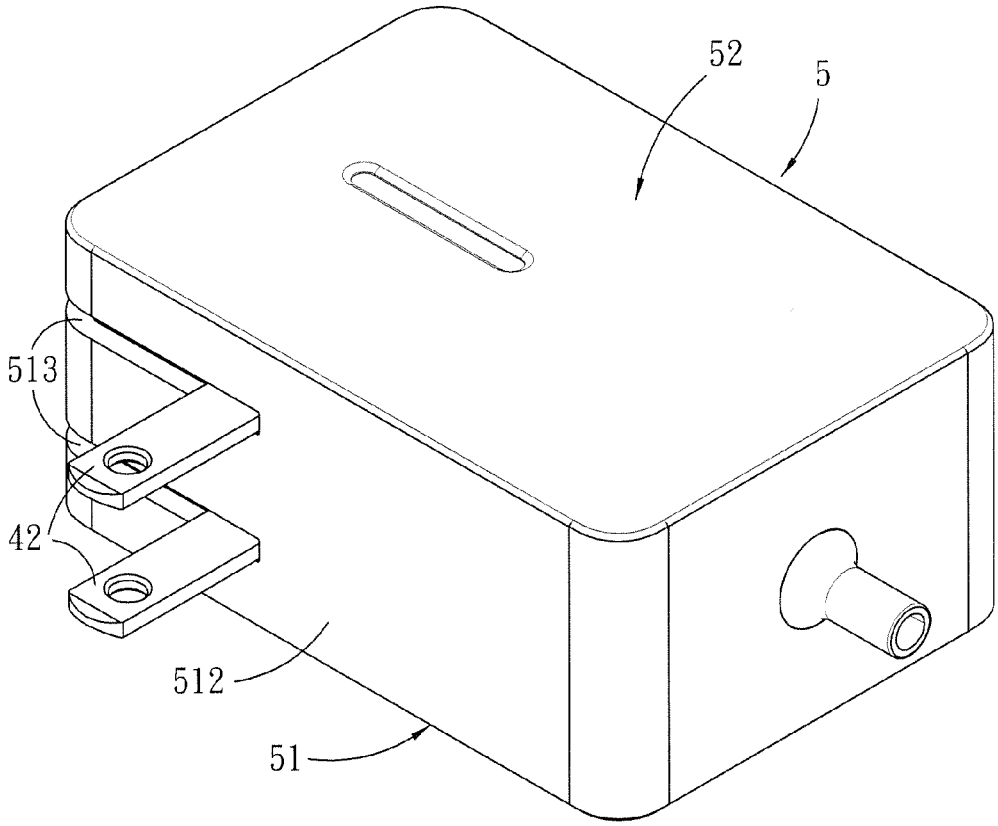
FIG. 20 is a view similar to FIG. 19, but with the second housing element of the power supply device being coupled to the first housing element thereof.

In the non-use position, as shown in FIG. 18, the insert sections 421 of the prongs 42 are accommodated in the slots 513. When the insert sections 421 are rotated in the direction of the arrow (I), as shown in FIGS. 19 and 20, the insert sections 421 are moved to extend out of the respective slots 513. When the insert sections 421 are rotated in the direction of the arrow (II), the insert sections 421 are moved back to the position shown in FIG. 18.

In summary, because each arcuate conductive protrusion 44 has at least two points of contact with the depressed contact surface 311 of the corresponding conductive section 31, the rotatable plug of the present invention has a good effect of conduction. Further, the conductive terminals 3 are insert molded into the first casing part 21 so that only the conductive sections 31 and the conductive ends 32 thereof protrude inwardly from the inner surface of the first casing part 21, the fixing method thereof is stable and the electrical connection thereof is reliable. Finally, with only the first and second protuberances 45, 46 cooperating alternately with the positioning groove 217 to position the rotatable unit 4 in the non-use and use positions, and through the connection of the first and second casing parts 21, 22, the present invention can be modular. Hence, the objects of the present invention can be realized.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A rotatable plug comprising:

a casing unit including a first casing part, and a second casing part connected to said first casing part and formed with a pair of receiving spaces;

a pair of conductive terminals insert molded into said first casing part, each of said conductive terminals having a conductive section; and a rotatable unit including a pivot shaft, a pair of conductive prongs connected transversely to said pivot shaft, and a pair of conductive protrusions protruding out from said pivot shaft, said rotatable unit being disposed in said casing unit and being rotatable relative to said casing unit between a non-use or folded position, where said conductive prongs are respectively accommodated in said receiving spaces, and a use or extended position, where said conductive prongs respectively extend out of said receiving spaces, each of said conductive protrusions being disposed on and having at least two points of contact with said conductive section of a respective one of said conductive terminals when said rotatable unit is in said use position.

2. The rotatable plug as claimed in claim 1, wherein said conductive section of each of said conductive terminals has a depressed contact surface, each of said conductive protrusions having the at least two points of contact with said depressed contact surface.

3. The rotatable plug as claimed in claim 1, wherein said first casing part includes a pair of first support posts each having a slotted surface, each of said conductive terminals further having a conductive end protruding from said slotted surface, said pivot shaft including two outer conductive shaft sections respectively connected to said prongs, and an insulated middle shaft section between said outer conductive shaft sections, said outer conductive shaft sections being respectively in contact with said conductive ends of said conductive terminals when said rotatable unit is in said use and non-use positions.

4. The rotatable plug as claimed in claim 1, wherein said first casing part includes a pair of second support posts supporting said pivot shaft.

5. The rotatable plug as claimed in claim 1, wherein said first casing part has a positioning portion formed with a positioning groove, said rotatable unit further including a first protuberance and a second protuberance protruding from said pivot shaft between said conductive protrusions and perpendicular to each other, said first protuberance being positioned in said positioning groove when in said non-use position, said second protuberance being positioned in said positioning groove when in said use position.

6. The rotatable plug as claimed in claim 1, wherein each of said conductive terminals further has a conductive extension disposed externally of said casing unit.

7. The rotatable plug as claimed in claim 6, wherein said conductive extensions of said conductive terminals have different lengths.

8. A power supply device comprising:

a housing unit including a first housing element having two parallel slots, and a second housing element connected to and cooperating with said first housing element to define a chamber;

a circuit unit disposed in said chamber; and a rotatable plug disposed in said chamber and including a casing unit including a first casing part, and a second casing part connected to said first casing part and formed with a pair of receiving spaces;

a pair of conductive terminals insert molded into said first casing part and connected electrically to said circuit unit, each of said conductive terminals having a conductive section; and a rotatable unit including a pivot shaft, a pair of conductive prongs connected transversely to said pivot shaft, and a pair of conductive protrusions protruding out from said pivot shaft, said rotatable unit being disposed in said casing unit and being rotatable relative to said casing unit between a non-use or folded position, where said conductive prongs are respectively accommodated in said receiving spaces and said slots, and a use or extended position, where said conductive prongs respectively extend out of said receiving spaces and said slots, each of said conductive protrusions being disposed on and having at least two points of contact with said conductive section of a respective one of said conductive terminals when said rotatable unit is in said use position.

9. The power supply device as claimed in claim 8, wherein said conductive section of each of said conductive terminals has a depressed contact surface, each of said conductive protrusions having the at least two points of contact with said depressed contact surface.

10. The power supply device as claimed in claim 8, wherein said first casing part includes a pair of first support posts each having a slotted surface, each of said conductive terminals further having a conductive end protruding from said slotted surface, said pivot shaft including two outer conductive shaft sections respectively connected to said prongs, and an insulated middle shaft section between said outer conductive shaft sections, said outer conductive shaft sections being respectively in contact with said conductive ends of said conductive terminals when said rotatable unit is in said use and non-use positions.

11. The power supply device as claimed in claim 8, wherein said first casing part includes a pair of second support posts supporting said pivot shaft.

12. The power supply device as claimed in claim 8, wherein said first casing part has a positioning portion formed with a positioning groove, said rotatable unit further including a first protuberance and a second protuberance protruding from said pivot shaft between said conductive protrusions and perpendicular to each other, said first protuberance being positioned in said positioning groove when in said non-use position, said second protuberance being positioned in said positioning groove when in said use position.

13. The power supply device as claimed in claim 8, wherein each of said conductive terminals further has a conductive extension disposed externally of said casing unit.

14. The power supply device as claimed in claim 13, wherein said conductive extensions of said conductive terminals have different lengths.

15. The power supply device as claimed in claim 8, wherein each of said receiving space includes a cover-receiving section, and a prong-receiving section communicating spatially with said cover-receiving section, each of said slots having a length greater than or equal to a length of a corresponding said receiving space and a width greater than or equal to a width of a corresponding said prong-receiving section.

* * * * *